United States Patent [19]

Chen et al.

[11] 4,305,809

[45] Dec. 15, 1981

[54] FIXED SULFUR PETROLEUM COKE FUEL AND METHOD FOR ITS PRODUCTION

[75] Inventors: Nai Y. Chen, R.D. Titusville, N.J.; Dennis E. Walsh, Richboro, Pa.

[73] Assignee: Mobil Oil Corporation, New York, N.Y.

[21] Appl. No.: 127,667

[22] Filed: Mar. 6, 1980

[51] Int. Cl.[3] ..... C10G 9/32; C10G 19/073

[52] U.S. Cl. ..... 208/127; 208/226

[58] Field of Search ..... 208/127, 208 R, 226, 208/131; 44/1 SR

[56] References Cited

U.S. PATENT DOCUMENTS

| | | | |
|---|---|---|---|
| 2,921,017 | 1/1960 | Johnson | 208/106 |
| 2,953,518 | 9/1960 | McKinley | 423/442 |
| 2,968,611 | 1/1961 | Schutte | 208/208 R |
| 3,481,834 | 12/1969 | Squires | 208/127 |
| 3,707,462 | 12/1972 | Moss | 208/127 |
| 3,723,291 | 3/1973 | Thakker | 208/126 |
| 3,873,427 | 3/1975 | Fong | 423/461 |
| 3,907,662 | 9/1975 | Kubota | 208/127 |
| 3,915,844 | 10/1975 | Ueda | 208/127 |

*Primary Examiner*—T. M. Tufariello

*Attorney, Agent, or Firm*—Charles A. Huggett; Michael G. Gilman; Charles J. Speciale

[57] ABSTRACT

A fixed-sulfur, solid fuel product is obtained by an improved coking process wherein petroleum fractions are coked in the presence of added alkaline earth metal oxides. The fixed-sulfur, solid fuel product comprises coke and from about 3 to 30 weight percent, preferably from about 5 to 15 weight percent, "ash" (calculated as calcium oxide) derived from the alkaline earth additive. The quantity alkaline earth metal oxide or precursor thereof added to the coking zone is dependent on the sulfur content of the product coke and on the desired ash content of the solid fuel product. The coking zone may comprise delayed, fluid bed, or moving bed cokers.

17 Claims, 1 Drawing Figure

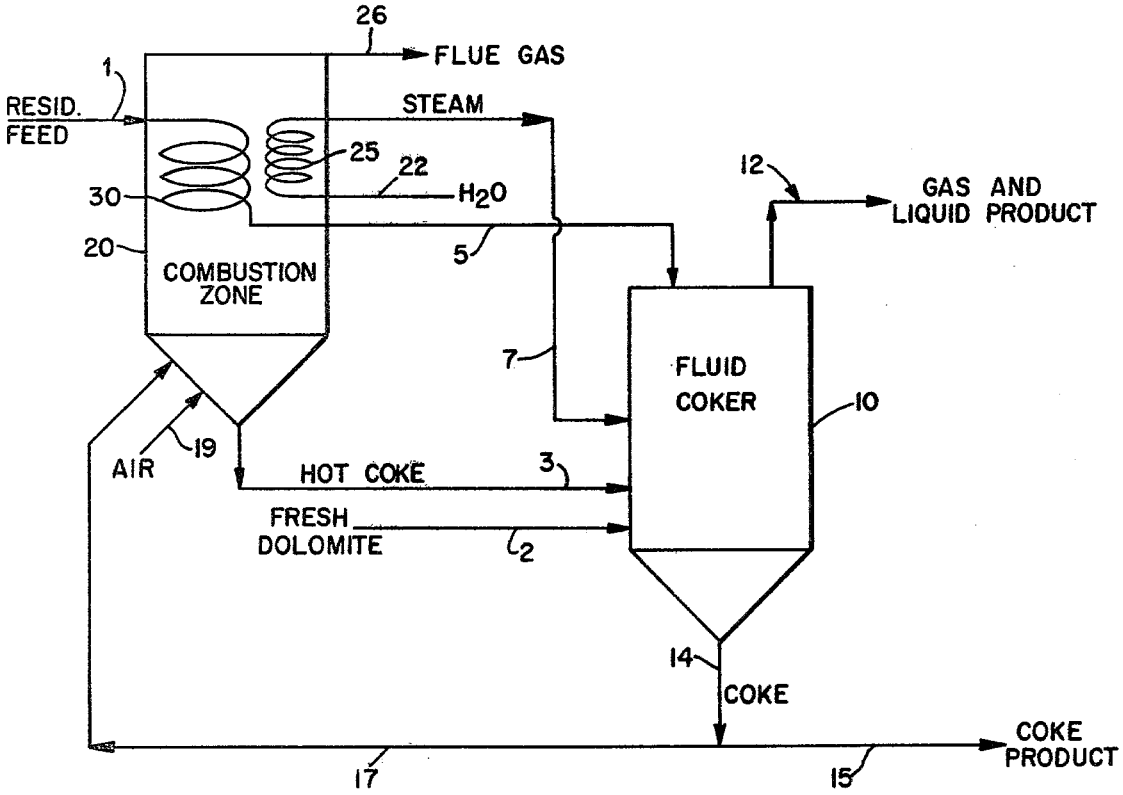
26
FLUE GAS
1
RESID.
FEED
STEAM
25
22
30
$H_2O$
12
GAS AND
LIQUID PRODUCT
20
5
COMBUSTION
ZONE
7
FLUID
COKER
10
19
AIR
HOT COKE
3
FRESH
DOLOMITE
2
14
COKE
COKE
PRODUCT
17
15

FIXED SULFUR PETROLEUM COKE FUEL AND METHOD FOR ITS PRODUCTION

BACKGROUND OF THE INVENTION

1. Field of the Invention

This invention relates to the conversion of heavy, sulfur-containing, petroleum feedstocks and more particularly to processes for coking sulfur-containing residual petroleum feedstocks with added inorganic material containing an alkaline earth metal oxide or a substance forming alkaline earth metal oxides under coking conditions. This invention also relates to a clean-burning, fixed-sulfur, solid fuel product and method for its production.

2. Description of the Prior Art

Coking is an increasingly important processing area in petroleum refining. As high quality crudes become scarcer and more expensive, refineries must process increasing quantities of lower quality crudes which contain or, upon processing, form large amounts of high-boiling materials that are typically treated in coking units. Thus, the quality and quantity of products produced by coking processes can have a large impact on overall refinery yields because the relative amount of feedstock to be coked generally increases as the quality of crude oil material decreases.

Principle heavy petroleum coking feedstocks are high-boiling virgin or cracked petroleum residua such as virgin reduced crude, bottoms from vacuum distillation (vacuum reduced crude), thermal tar and other residue and blends thereof. Coking enables efficient conversion of these less desirable petroleum fractions to more desirable distillate products and a byproduct coke.

A variety of coking methods are known in the art including delayed, fluid, and moving bed coking processes.

Delayed coking is a process wherein the feedstock is preheated to a coking temperature, generally between 800° F. to about 1100° F. and more usually between about 850° F. to 950° F. The preheated feedstock is then fed to the bottom of a delayed coker drum. The coking feed is allowed to soak in its own heat in the delayed coker at a low pressure, generally from about one atmosphere to about 10 atmospheres absolute, preferably from about three atmospheres to about seven atmospheres absolute. The cracked vapors are continuously removed overhead so as to recover the distillate fuels while coke is allowed to build up in the drum to successive higher levels. When the drum is filled with coke, the preheated feed is diverted to a succeeding drum and the former drum is steamed out and cooled. The coke is then removed from the cooled drum.

Fluid coking is a process wherein feedstock is sprayed into a bed of hot fluidized coke particles in a reactor. The feedstock is cracked into lighter vapor-phase products and into coke, the coke being deposited on the particles of the fluidized bed. The particles of coke are circulated from the reactor to a burner wherein they are partially combusted with an oxygen-containing gas in a moving, fluid, or transfer line combustion zone and thereby raised in temperature, some of the heated coke particles being returned to the reactor for further use, the remainder of the coke being withdrawn as a byproduct. In a typical fluid coking unit the feedstock is converted to about 70% of normally liquid products and about 25% of coke, and 7–8% of the latter (based on charge) is consumed in the burner to provide heat for the process.

Moving bed coking is a process wherein the feedstock is uniformly distributed to the top of a mass of heated granular petroleum coke particles maintained in a reactor through which the particles downwardly pass by gravity. The liquid hydrocarbon charge is converted by the heat of the particles to produce lower-boiling vapors and a dry coke coating on the particles. The coated coke particles are withdrawn from the bottom of the reactor and either recovered as a coke byproduct or passed to a burner similar to that employed in fluid coking processes to raise the coke particle temperature for return to the coking reactor.

Sulfur compounds present in crude petroleum include thiols (mercaptans) and open-chain and cyclic sulfides. Other compounds such as thiophenes are aromatic thiols may be present in cracked petroleum products but their presence in naturally-occurring petroleum is doubtful. As the sulfur content of the crude increases, there is a tendency toward sulfur distributions in distillation products wherein as much as 90% or more of the sulfur content of the crude is present in distillation residues. Because distillation residues are typically treated in coking units, the problems presented by sulfur contaminants in the refining of petroleum have special importance in coking processes.

When coking feedstocks containing sulfur and other materials such as vanadium and sodium which are generally regarded as deleterious contaminants, the sulfur contaminants tend to be roughly equally distributed between the solid, normally liquid, and normally gaseous products and the other contaminants tend to be concentrated in the solid coke product. As a result, the uses to which the coke may be put are restricted. For example, when coke containing sulfur is burned, the sulfur is liberated as sulfur oxides which are noxious and corrosive, presenting a serious atmospheric pollution problem. The difficulties associated with sulfur contamination are accentuated by the present trend toward the use of higher sulfur content crude oils in many refineries.

Several alternatives have been suggested for overcoming this problem. More particularly, a wide variety of processes have been proposed for producing desulfurized petroleum coke. For example, U.S. Pat. Nos. 2,768,939 and 3,130,333 suggest desulfurizing coke by hydrogenation. U.S. Pat. No. 2,824,047 suggests desulfurization of char or coke with hydrogen in the presence of an "acceptor" compound for hydrogen sulfide capable of maintaining a low ratio of hydrogen sulfide to hydrogen in the operation. Various substances containing lime were proposed for the acceptor, including calcined dolomite. A similar method is disclosed in U.S. Pat. No. 3,481,834 which suggests a process for converting sulfurous petroleum residual oil into low sulfur products by coking the liquid hydrocarbons in a first zone containing a fluidized bed of coke pellets and maintaining a separate but contiguous zone comprising a fluidized bed of a solid containing a substance "avid to receive sulfur from hydrogen sulfide", wherein the coked solids from the first zone and "sulfur-avid" solids comingle. Spent solid "sulfur-avid" substances, which may be oxides of calcium, manganese, iron, lead, or copper are removed from the second zone and regenerated. For example, calcium sulfide is converted to calcium carbonate and hydrogen sulfide by treatment with steam and carbon dioxide at elevated pressure and at a temperature below 1300° F. in a "reducing" atmosphere to avoid explusion of sulfide dioxide and to prevent oxidation of calcium sulfide to form calcium sulfate.

Methods have also been proposed for producing desulfurized petroleum coke which comprise adding various materials to the coking zone itself.

U.S. Pat. No. 2,921,017 suggests mixing powdered sodium carbonate with a coker feedstock, coking resulting mixture in a "calciner coker" at about 1400° F., washing the resulting coke product, and recovering a desulfurized coke product. Alternatively, the '017 patent suggests initially coking the sodium carbonate/coker feedstock mixture at a temperature of about 900° F., raising the temperature of the resulting sodium carbonate/coke mixture to 1400° F. in a separate vessel to complete the coking and desulfurization, and washing the resulting solid.

U.S. Pat. No. 2,968,611 suggests adding desulfurizing agents such as aluminum hydrate, boron oxide, iron oxide, clays or bauxite to a heavy hydrocarbon charge to a moving bed coker.

U.S. Pat. No. 3,723,291 suggests a method of producing coke of reduced sulfur content by adding an alkali metal carbonate to coker feedstock prior to coking and then, after coking, treating the coke product with hydrogen at elevated temperatures (1000° to 2000° F.), releasing sulfur from the coke as hydrogen sulfide.

U.S. Pat. No. 3,873,427 suggests adding a desulfurizing agent containing iron or iron oxide and a chloride of magnesium, calcium or iron to a coker feedstock, coking the resulting mixture in a delayed or fluid coker, desulfurizing the resulting coke in conventional calcining equipment at temperatures of at least 2100° F. under reducing conditions, and recovering a coke product containing no more than 0.85% sulfur.

U.S. Pat. No. 3,907,662 discloses a method for producing desulfurized light oil and fuel gas from heavy oil which comprises coking and heavy oil in a fluidized bed of particles comprising an alkali metal carbonate compound maintained at a temperature of 470°-550° C.; recovering volatile products from the first low-temperature fluidized coking zone; passing the carbonaceous particles formed in the first zone to a second fluid bed coking zone maintained at a temperature of 600°-800° C. and recovering additional volatile products and forming coke solids containing alkali metal sulfides; regenerating the alkali metal sulfide solids and recovering fixed sulfur as hydrogen sulfide; heating and gasifying the regenerated alkali metal carbonate/coke particles to form a heated fuel gas; and returning the particles containing alkali metal carbonate, from which most of the coke has been removed, to the second, high-temperature fluid bed coking zone. At column 9, line 10-13, the patent teaches that other particles having desulfurization effect can be used in addition to the alkali metal carbonate compound and suggests dolomite as an example of such a compound.

U.S. Pat. No. 3,915,844 discloses an improved fluid coking method for the treatment of heavy hydrocarbon feedstocks wherein particles consisting of an alkali metal compound heated to a temperature of 100°-500° C. higher than the temperature of the coking zone are added to the coking zone to seed formation and growth of coke. The coke product is gasified and particles comprising alkali metal compound are returned to the coking zone. In one embodiment of this process, the alkali metal compound is supported on an alkaline earth metal compound, i.e., calcium oxide, calcium carbonate, magnesium oxide, magnesium carbonate and dolomite.

U.S. Pat. No. 3,707,462 suggests a method of converting a sulfur-containing, heavy petroleum feedstock which method comprises coking the feedstock in a first zone containing a fluidized bed of calcium oxide or a precursor thereof at a temperature of between 500°-700° C., recovering vapors comprising normally liquid and gaseous products of reduced sulfur content and carbonaceous material of increased sulfur content which deposits on the calcium oxide particles from the first zone, partially removing the carbonaceous deposits formed on the calcium oxide particles in a second zone by combustion of a fluidized bed of the solids at a temperature 800°-1000° C., transferring some of the partially combusted solids from the second zone to the first zone, transferring the remainder of the partially combusted solids from the second zone to a third zone wherein the particles are fluidized at a temperature 1000°-1100° C. in an oxygen containing gas to convert at least some of the calcium sulfide present to calcium oxide with the release of sulfur dioxide, and transferring the desulfurized oxidized particles from the third zone back to the first zone. The patent teaches that the temperature and oxidizing potential in the second zone should be maintained such that the carbonaceous deposit is substantially removed from the particles therein without causing sulfur to be lost from the particles.

Although it is not concerned with sulfur removal, U.S. Pat. No. 2,953,518 discloses an improved fluid coking operation which comprises employing a seed material consisting essentially of calcium oxide in amounts equal to about 45-75% of the fluidized bed. This process is said to minimize agglomerating tendencies in the coking zone and to produce a solid byproduct suitable for the manufacture of calcium carbide. A portion of the solid, coke-lime byproduct is burned and returned to the fluid coking zone to provide the necessary heat of reaction.

SUMMARY OF THE INVENTION

Unlike the foregoing processes, the present invention is not concerned with producing a desulfurized petroleum coke product. Rather, an object of the present invention is a fixed-sulfur, solid fuel product which may be burned without the release of sulfur-containing compounds in the flue gas. A related object of this invention is an improved coking process for converting sulfur-containing petroleum coker feedstocks into high quality distillates and a petroleum coke byproduct which has improved combustion characteristics and other desirable chemical and physical qualities.

These objects and others are accomplished by coking heavy petroleum coker feedstocks in the presence of added alkaline earth metal oxides and recovering vapor products comprising normally liquid and gaseous products and a solid product comprising carbonaceous material derived from the feedstocks deposited on particles of the added alkaline earth metal compounds. The quantity of fresh alkaline earth metal compound added to the coking reactor is generally within the range of about 2 to 20 pounds per 100 pounds of feedstock and depends on the sulfur content and the desired ash content of the fixed-sulfur, solid fuel product.

Alkaline earth metal oxides, especially calcium oxide, are capable of desulfurizing a wide range of organic sulfur compounds, such as, for example, mercaptans and organic sulfides, the predominant forms of sulfur compounds found in coker feedstocks. When sulfur-containing petroleum coker feedstocks are coked in the presence of particles of alkaline earth metal oxides, the feedstock is converted into vapors comprising normally liquid and gaseous products and to carbonaceous material which deposits on the alkaline earth metal oxide particles. Although the added particles may effect some sulfur removal from the normally liquid and gaseous products recovered from the coking unit, the primary effect of the addition is the fixation of the sulfur contained in the carbonaceous deposit. While not wishing to be bound by any theory of operability, it appears that sulfur fixation occurs via the reaction between sulfur compounds contained in the heavier material forming the carbonaceous deposit and the alkaline earth metal oxides of the particles on which the deposit forms.

Accordingly, the quantity of alkaline earth metal oxides added to the coking zone of the process of this invention is determined with reference to the sulfur content of the coke produced from the sulfur-containing coker feedstock. The amount of alkaline earth metal oxide theoretically required for fixation of sulfur contained in the product coke is one gram-mole of alkaline earth metal oxide per gram-atom of sulfur in the product coke. Since alkaline earth metal oxides, and calcium oxide in particular, are highly reactive towards organic sulfur compounds in the coking zone environment, the quantity of alkaline earth metal oxide added to the coking zone is desirably about the amount theoretically required for fixation of the sulfur content of the coke. Somewhat less than the theoretical amount may be employed if some sulfur emissions may be tolerated upon later coke combustion. Broadly, from about 1 to 10 times the theoretical amount of alkaline earth metal compound is added to the coking zone.

BRIEF DESCRIPTION OF THE DRAWING

The FIGURE is a schematic diagram of a fluid coking embodiment of the process of this invention.

DETAILED DESCRIPTION OF THE INVENTION

Considering availability, reactivity and cost effectiveness, the preferred alkaline earth metal oxide is calcium oxide, although other alkaline earth metal oxides may also or alternatively be used. Calcium oxide is conveniently provided as lime or may be derived from materials such as limestone or dolomite. As known in the art, the calcium carbonate content of limestone or dolomite may be converted at low temperatures to reactive lime. This conversion may be performed either before the material is added to the coking zone or in the coking zone itself.

The quantity of coke formed from a particular feedstock under particular operating conditions is readily ascertained by one skilled in the art. Similarly, the sulfur content of the coke is readily ascertainable by one skilled in the art. The quantities may be available from previous operating experience or may be estimated using known techniques. Typically, the sulfur content of the feedstock is roughly equally distributed between the normally gaseous, normally liquid, and solid products recovered from the coking unit. As much as about 30 to 40 wt. % of the sulfur content of the feedstock may be recovered from the coking unit as "coke sulfur". The amount of alkaline earth metal oxide added to the coking zone where the feedstock is charged is about 1.75 to 17.5 parts alkaline earth metal oxide (calculated as CaO) per part of coke sulfur produced from the feedstock.

The method employed to coke the heavy petroleum coker feedstock is not broadly critical to this invention and may be any of the known methods, including delayed, moving bed, and fluid coking processes. Similarly, the selection of the heavy petroleum coker feedstock does not form a part of this invention although feedstocks containing from about 0.5 to 6 weight percent sulfur are generally contemplated and the method of this invention is particularly suited to handle feedstocks containing from about 1 to 3 weight percent sulfur.

The fixed sulfur solid fuel product of this invention will contain from about 3 to 30 weight percent "ash" (calculated as calcium oxide) derived from the particles of alkaline earth metal compounds added to the coking zone. The composition of the fuel, especially the carbon and "ash" content, will vary depending upon the coking tendency of the feedstock, the sulfur contents of the feedstock and the coke product produced therefrom, the particular alkaline earth metal material employed (for example, use of dolomite as the calcium oxide source results in a higher ash content than the use of lime), and the coking method. Because ash may be a problem when the fuel is burned, the fixed-sulfur solid should desirably contain from about 5 to 15 weight percent ash and preferably about 10 weight percent ash.

During the coking operation most of the sulfur is fixed as calcium sulfide which becomes stabilized in ash formed when the solid is burned as a fuel. Unreacted sulfur-containing petroleum constituents in the solid coke product may also be fixed by unreacted calcium oxide contained in the fuel particle during the initial stages of its subsequent combustion. During combustion of the solid fuel product, calcium sulfide present or formed in the combustion zone is oxidized to calcium sulfate, releasing substantial heat energy and stabilizing the sulfur content of the fuel in the ash.

Regarding the subsequent use of the fixed sulfur coke product to this invention as fuel, it should be noted that sulfur-containing calcium compounds, when oxidized at temperatures in excess of about 1900° F., form calcium oxide and significant quantities of sulfur dioxide gas may be evolved. Clearly, in order to obtain the objects of this invention, combustion temperatures should be maintained below about 1900° F. when using the fixed-sulfur coke product as a fuel. Generally, combustion temperatures within the range from about 1000° F. to 1750° F. are contemplated.

In the delayed coking embodiment of the process of this invention, heavy, sulfur-containing coker feedstocks are preheated to a coking temperature, generally within the range from about 800° F. to 1100° F. and preferably between about 850° F. to about 950° F., and charged to the delayed coker drum. Alkaline earth metal oxides or substances forming alkaline earth metal oxides may be added to the feedstock before or after preheating. Preferably, the oxide is added to the coker feedstock before preheating, the temperature of the resulting mixture is raised to coking temperature, and the heated mixture is then charged to the coking drum. The amount of alkaline earth metal compound added has been described above and preferably is the equivalent of about 1.75 to 17.5 parts of calcium oxide per part of sulfur in the coke product. Vaporous products are recovered from the drum as the coking reactions proceed and as the drum fills with coke. The fixed-sulfur, delayed coke fuel product of this invention is recovered from the drum by conventional means.

The particles of alkaline earth metal oxides or precursors thereof which are added to the delayed coking zone sould have a diameter in the range from about 10 to 300 Mesh and preferably from about 100 to 200 Mesh.

In the continuous coking embodiments of this invention, i.e., in fluid or moving bed coking process, particles of alkaline earth metal oxides or their precursors may be added with the coker feedstock to the coking zone or may be separately charged to the coking zone. In both types of continuous cokers, particles comprising coke and at least partially sulfurized alkaline earth metal oxides are recycled to the coking zone to provide the necessary heat for coking the feedstock. Unlike processes known in the art, such as that described in U.S. Pat. No. 3,707,462, no attempt is made to completely remove the carbonaceous deposits from these recycled particles in the process of the present invention. Rather, only sufficient carbon is combusted in the combustion zones to raise the temperature of the coke particles to that necessary to sustain the reactions effected in the coking zones. Fixed-sulfur, fluid or moving bed coke fuel products may be recovered either before or after, preferably before, the coked particles removed from the coking zone pass to the combustion zones of these coking methods.

Thus, fresh particles of alkaline earth metal oxides or their precursors are continuously added to the continuous coking zones in an amount dependent upon the sulfur content of the coke produced from the hydrocarbon coker feedstock and the desired ash content of the fixed-sulfur solid fuel product. Particles comprising coke and at least partially sulfurized alkaline earth metal oxide particles are continuously recovered from the coking zone and at least a portion of the recovered particles pass to a combustion zone wherein some of the carbonaceous deposit on the sulfurized metal oxide particles is burned to raise the temperature of the particles to the desired temperature for return to the coking zone. The desired temperature for return to the coking zone is known in the art and should be within the range from about 950° to about 1300° F. The temperature of the combustion zone should be 50° to 300° F. higher than the coking zone. It can be operated as a moving bed or as a fluidized bed. Transfer-line burners wherein the particles are oxidized while being transferred from the bottom to the top of the continuous coker are particularly advantageous.

Fresh particles of alkaline earth metal oxides or their precursors may be added to the feedstock before it is preheated and introduced into the continuous coker. This enables preheating of the alkaline earth particles with the feedstock to a temperature desirable for subsequent admixture with the fluid or moving bed in the coking zone. The fresh particles may also be added to the combustion zone of continuous cokers. However, this is not preferred because the temperature and $CO_2$ content of the combustion zone may lead to carbonization of alkaline metal oxides, forming carbonates. In a preferred embodiment of the process of this invention, the fresh alkaline earth particles are fed directly to the coking zone with optional preheating. It is also possible to slurry the particles with part of the coker feedstock and to combine such a technique with one of the foregoing.

The particles withdrawn from the fluid- or moving bed-coking zones will contain from about 3 to 30 weight percent, preferably from about 5 to 15 weight percent "ash" (calculated as calcium oxide) derived from the sulfur-fixing additive. In order to maximize the carbon content of the fixed-sulfur, solid fuel byproduct, the byproduct is preferably withdrawn from the particles recovered from the coking zone. However, the ratio of solids recovered as byproduct to solids passed to the combustion zone is adjusted such that about 10 to 40 weight percent of the carbonaceous deposit on the particles passing to the combustion zone will be burned therein to raise the particles to the desired temperature for return to the coking zone. Maintenance of a substantial carbon deposition on the desulfurized alkaline earth metal particles assures that sulfur contained therein will remain fixed.

Maintenance of a substantial carbon deposition on the particles also improves the heat-carrying capacity of the heated particles recycled to the coking zone. The heat capacity of carbon-free "ash" particles is less than about 90% of the heat capacity of the carbonaceous deposit itself. Therefore, when compared to processes wherein carbonaceous deposits on desulfurizing additives are substantially removed in the combustion zone, as much as about 10% less solids will need to be recycled to the coking zone of this invention in order to raise and maintain the coker feedstock at coking temperatures. According to the present invention, the rate of "coke" particle recycled to the coking zone is dependent on heat transfer considerations, fresh alkaline earth particles being added in response to the sulfur content of the coke produced from the coker feedstock.

Another consideration effecting the relative amount of solids recovered from the coking zone which are passed to the combustion zone is the need to maintain a definite particle zie distribution in the coking zone, particularly in fluid bed coking zones. For all of the above reasons, the particles returned to the coking zone from the partial combustion zone of the fluid or moving bed embodiments of the process of this invention should contain about 4 to 40 weight percent, preferably from about 4 to 25 weight percent "ash" (calculated as calcium oxide) derived from added alkaline earth particles. More preferably, the particles contain about 6 to 18 weight percent ash and about 82 to 94 weight percent coke.

The particles of alkaline earth metal oxides or precursors thereof which are added to a fluid coking zone should be within the fluidizable particle size range and may range up to about 1000 microns in diameter, preferably the diameter is from about 40 to 500 microns. The particles of alkaline earth metal oxides or precursors thereof which are added to a moving bed coking zone should be within the range from about 40 to 300 Mesh.

Referring now to the FIGURE, a preferred embodiment of the process of this invention employing a fluid bed coking zone will be described.

Heavy sulfur containing feedstock 1, heated to a temperature within the range of about 450° to 750° F. in heating coils 30 immersed in a bed of solids maintained in combustion zone 20, passes through line 5 to coking zone 10. Coking zone 10 contains a fluid bed of recycled solids introduced via line 3 and dolomite particles introduced via line 2. The coking zone 10 is maintained at a temperature within the range of from about 900° to 1000° F. and the solids therein are fluidized by steam introduced via line 7 and by thermally cracked products released in the zone 10. The partial pressure of steam in the vapor phase present in the coking zone should be less about 11 atmospheres to prevent hydration of calcium oxide to form calcium hydroxide and preferably is within the range from about 0.1 to 3 atmospheres. Decarbonization of the calcium carbonate content of the dolomite readilly occurs in the coking zone, forming highly reactive calcium oxide. It is understood that precalcined dolomite or other calcium-oxide-containing materials may alternatively be added to coking zone 10. As coking reactions proceed in the fluid coking zone 10, carbonaceous material deposits on the hot coke and the at least partially sulfurized dolomite particles and the heavier, coated particles tend to gravitate toward the bottom of the fluid bed. Normally gaseous and liquid products are withdrawn from the coking zone through line 12. Solid particles comprising coke and dolomite are withdrawn from coking zone 10 through line 14 and a portion of those solids are recovered as a fixed-sulfur, solid fuel product 15. The remainder of the solids pass through line 17 to combustion zone 20 wherein a portion of the carbonaceous deposit is burned with fluidizing air introduced via line 19. In the embodiment shown, sufficient heat is released in combustion zone 20 to raise the temperature of the particles to about 1000° to 1750° F., to preheat the feedstock 1, and to produce process steam 27 from water introduced through line 22 into coils 25 immersed in the fluid bed of particles present in combustion 20. Carbon monoxide-rich flue gas with is withdrawn through line 26 for subsequent use, e.g., as fuel.

It will be understood that the embodiment described is illustrative of the process of this invention but modifications and variations thereof apparent to one skilled in the art are included within the scope of this invention.

What is claimed:

1. A process of producing a fixed-sulfur petroleum coke fuel which comprises coking a heavy petroleum coker feedstock in the presence of an added alkaline earth metal oxide or precursor thereof, the amount of added alkaline earth metal oxide being within the range from about 1 to 10 times the amount theoretically necessary to completely fix the sulfur contained in the coke produced from the petroleum coker feedstock, and recovering coker products including a fixed-sulfur petroleum coke fuel byproduct comprising coke and about 3 to 30 weight percent ash (calculated as calcium oxide) derived from the alkaline earth additive.

2. The method of claim 1 wherein the heavy petroleum coker feedstock contains from about 0.5 to 6 weight percent sulfur.

3. The method of claim 2 wherein the fixed-sulfur petroleum coke fuel byproduct comprises coke and about 5 to 15 weight percent ash derived from the alkaline earth additive.

4. The method of claim 2 wherein the fixed-sulfur petroleum coke fuel byproduct comprises coke and about 10 weight percent ash derived from the alkaline earth additive.

5. The method of claim 1 wherein the coking process employed is delayed coking.

6. The process of claim 1 wherein the added alkaline earth metal oxide or precursor thereof is selected from the group consisting of lime, limestone, dolomite, and mixtures thereof.

7. The process of claim 1 wherein the added alkaline earth metal oxide comprises calcium oxide.

8. In a continuous process of coking a heavy petroleum coker feedstock wherein at least a portion of the coke produced in the coking zone is burned to raise its temperature above the coking zone temperature and is then recycled to the coking zone to provide heat for the coking reactions, the improvement which comprises:

a. coking the heavy petroleum coker feedstock in the presence of an added alkaline earth metal oxide or precursor thereof, the amount of added alkaline earth metal oxide being within the range of about 1 to 10 times the stoichiometric amount necessary to completely fix the sulfur contained in the coke produced from the petroleum coker feedstock;

b. recovering normally liquid and gaseous hydrocarbons and solid particles comprising coke and about 3 to 30 weight percent ash (calculated as calcium oxide) derived from the alkaline earth additive from the coking zone;

c. partially combusting at least a portion of said particles to raise the temperature thereof above the coking zone temperature, the heated solid particles comprising coke and about 4 to 40 weight percent ash (calculated as calcium oxide) derived from the alkaline earth additive from the coking zone; and returning said heated solids to the coking zone; and d. recovering the remaining solid particles as a fixed-sulfur petroleum coke fuel byproduct.

9. The method of claim 8 wherein the fixed-sulfur petroleum coke fuel byproduct is a portion of the solid particles recovered in step b.

10. The method of claim 9 wherein the ratio of solids recovered as byproduct to solids combusted and returned to the coking zone is adjusted such that from about 10 to 40 weight percent of the carbonaceous deposit on the solid particles passing to the combustion zone will be burned therein to raise the temperature of the resulting particles to about 1000° to 1750° F. for return to the coking zone.

11. The method of claim 10 wherein the heavy petroleum coker feedstock contains from about 0.5 to 6 weight percent sulfur.

12. The method of claim 11 wherein the solid particles recovered in step b. comprise coke and from about 5 to 15 weight percent ash derived from the alkaline earth additive and the heated solid particles returned to the coking zone comprise coke and from about 4 to 25 weight percent ash derived from the alkaline earth additive.

13. The method of claim 12 wherein the solid particles returned to the coking zone comprise coke and from about 6 to 18 weight percent ash derived from the alkaline earth additive.

14. The process of claim 8 wherein the coking zone contains a fluidized bed of solids.

15. The process of claim 8 wherein the coking zone contains a moving bed of solids.

16. The process of claim 8 wherein the added alkaline earth metal oxide or precursor thereof is selected from the group consisting of lime, limestone, dolomite and mixtures thereof.

17. The process of claim 8 wherein the added alkaline earth metal oxide comprises calcium oxide.

* * * * *